US007594490B2

(12) United States Patent
Ono

(10) Patent No.: US 7,594,490 B2
(45) Date of Patent: Sep. 29, 2009

(54) ENGINE STARTER

(75) Inventor: Ryou Ono, Saitama (JP)

(73) Assignee: Zendah Co., Ltd., Saitama (JP)

( * ) Notice: Subject to any disclaimer, the term of this patent is extended or adjusted under 35 U.S.C. 154(b) by 0 days.

(21) Appl. No.: 12/062,990

(22) Filed: Apr. 4, 2008

(65) Prior Publication Data

US 2008/0223328 A1 Sep. 18, 2008

Related U.S. Application Data

(63) Continuation of application No. 11/199,297, filed on Aug. 8, 2005, now abandoned.

(30) Foreign Application Priority Data

Aug. 9, 2004 (JP) ..... 2004-232139
Aug. 9, 2004 (JP) ..... 2004-232140

(51) Int. Cl.
*F02N 3/02* (2006.01)
*F02N 5/02* (2006.01)
*F02N 11/00* (2006.01)
*F02N 15/06* (2006.01)
*F02N 15/02* (2006.01)

(52) U.S. Cl. ..... 123/179.24; 123/179.25; 123/185.14

(58) Field of Classification Search ..... 123/179.24, 123/179.25, 179.26, 185.14
See application file for complete search history.

(56) References Cited

U.S. PATENT DOCUMENTS 3,395,687 A 8/1968 Harkness
3,960,246 A * 6/1976 Fisher ..... 185/40 H
5,083,534 A 1/1992 Morishima et al.
5,115,773 A 5/1992 Morishima
5,163,392 A 11/1992 Morishima et al.
2002/0092493 A1 7/2002 Iida et al.
2004/0244755 A1 12/2004 Wians

FOREIGN PATENT DOCUMENTS

EP 0569951 A2 11/1993
JP 63-110672 U 7/1988
JP 2-13171 U 1/1990
JP 2573340 B2 10/1996
JP 2002-285940 A 10/2002
JP 2006-077758 A 3/2006

* cited by examiner

*Primary Examiner*—Stephen K Cronin
*Assistant Examiner*—Arnold Castro
(74) *Attorney, Agent, or Firm*—Darby & Darby PC

(57) ABSTRACT

An electric engine starter in which downsizing and weight saving are improved to an extreme based on the rational design and by eliminating an unnecessary unit, wherein a battery is arranged outside the starter, a power accumulating unit has a rotation supporting unit for supporting one end of a spring, a first gear is formed on the rotation supporting unit, a second gear is fixed to an output shaft of a high-speed reduction gear mechanism, the first and the second gears are engaged with each other, the power accumulating unit and the power transmission unit are arranged on the same first axis line, the compact electric motor and the high-speed reduction gear mechanism are arranged on the same second axis line parallel to the first axis line, and the first axis line and the second axis line are arranged on the same plane surface.

11 Claims, 10 Drawing Sheets

ENGINE STARTER

CROSS REFERENCE TO PRIOR APPLICATIONS

This application is a continuation of U.S. patent application Ser. No. 11/199,297, filed Aug. 8, 2005, which claims the benefit of Japanese Patent Application No. 2004-232139, filed Aug. 9, 2004, and Japanese Patent Application No. 2004-232140, filed Aug. 9, 2004, all of which are incorporated by reference herein in their entirety.

BACKGROUND OF THE INVENTION

1. Field of the Invention

The present invention relates to an engine starter which starts an internal combustion engine by using an ultra-compact direct current motor, and more particularly to an electric engine starter which can remove a conventional recoil driving unit from its body and arrange a battery for driving the motor, outside there, hence to realize downsizing because of the most efficient arrangement of the components and to extremely decrease fatigues at each operation of various working machine.

2. Description of the Related Art

At the present, an engine starter which starts a compact air-cooled gasoline engine mounted on a popular portable machine such as a shearing machine and a chain saw generally includes a recoil driving unit, a follower connected to a crank shaft of an engine through an switching means such as a centrifugal clutch, and a shock absorbing/pressure accumulating unit including a spring, arranged between the driving unit and the follower for absorbing the driving power of the driving unit and accumulating the pressure under the follower. The recoil driving unit has a recoiling reel with a recoil rope wound there and a recoiling spring arranged between the recoiling reel and a casing, the internal and external ends of the recoiling spring being respectively fixed to the recoiling reel and the casing. The recoiling reel is rotated only in one direction by drawing the recoil rope, the recoiling spring is wound up to accumulate a spring power, and when the recoil rope is released in this state, the accumulated power of the recoiling spring is released to wind back the recoiling reel automatically.

The above recoil driving unit requires a drawing operation for drawing the recoil rope every time of starting the engine. The drawing operation of the recoil rope has to be done so quickly and widely that a person having little power or an elderly person cannot start the engine only by one drawing operation. Thus, there have been a lot of proposals to make the engine start easy through the drawing operation of the recoil rope and they are in a practical use, but the troublesome operation of the drawing operation itself still remains. On the other hand, a progress in the recent compact electric motor and battery is remarkable and in spite of being downsized, they come to have the larger capacity. Taking this situation into account, an electric engine starter is reviewed which can start an engine quickly and easily by a switching operation, in order to avoid the troublesome operationality of the above recoiling starter, and its development is desired.

A compact electric engine starter of this kind includes the engine starter of old disclosed in, for example, Japanese Utility Model Application Laid-Open (JP-U) No. 63-110672 (patent document 1). This starter includes a direct current motor which is driven by the power of a battery, a spring which is wound up through the operation of a spring barrel drum by a warm gear fixed to an output shaft of the motor, an output rotation shaft to which the lateral end of the spring is fixed, a rotation shaft of the engine connected to the output rotation shaft through a one-direction clutch, a rotation lever which stops the rotation of the output rotation shaft or releases the stop, an interlock electric switch which operates to turn on only at a stage of releasing the rotation stop of the output rotation shaft by the lever, and an armature current controller which drives the motor at a time of turning off the electric switch, winds up the spring while keeping the rotation also when the rotation speed of the motor is beyond the set rotation speed, and stops the rotation of the motor by the power off when the rotation speed falls down below the set rotation speed at a time of finishing the winding up of the spring. A speed reducing gear may be interposed between the warm gear and a gear formed around the outer periphery of the spring barrel drum.

By way of example, Japanese Patent No. 2573340 (patent document 2) discloses a spring-driven starter which accommodates into a single frame a battery, a direct current electric motor driven by the electric power of the battery, a controller which controls the stop of the operation of the motor, a reduction gear mechanism of high reduction gear ratio which transmits the power of the motor, a spring-driven power accumulating unit or which is driven by the reduction gear mechanism, and a driving power transmitter which transmits the power of the accumulating unit to the crank shaft one-sidedly. The reduction gear mechanism of high reduction gear ratio includes a planetary reduction gear of the first stage to be driven by the direct current electric motor, which is arranged on the other axis line parallel to the crank shaft, and a reduction gear of the second stage which is formed by meshing a driven gear integrated with the outer periphery of the spring power accumulating room of the accumulating unit, with a driving gear provided on the output shaft of the planetary reduction gear.

For example, in JP-U No. 2-13171, a spring barrel drum is pivoted rotatably in one direction through a supporting system of the planetary reduction gear arranged at the opposite side of the crankshaft of the engine. The rotation speed of the spring barrel drum is reduced by the planetary reduction gear connected through a pair of reduction spur gears composed of a small gear and a large gear fixed to the output shaft of the direct current electric motor arranged within the housing. One-way rotation at this time is performed by the mesh of a ratchet claw and a tooth portion provided on the outer peripheral portion of the spring barrel drum. A start ratchet wheel and a start ratchet claw are arranged on the side of the crankshaft of the spring barrel drum and when the mesh is released, the ratchet wheel becomes rotatable. A starter ratchet wheel is built in the start ratchet wheel and the starter ratchet wheel is engaged in a centrifugal clutch claw provided in the crankshaft.

The ratchet wheel is integrated with the outer periphery of the spring barrel drum and the ratchet wheel of small diameter is engaged in the upper end portion of the spring barrel drum. A rotation shaft fixed to the ratchet wheel of small diameter is designed to remove a manual crank externally. During the ordinal operation of the engine, the manual crank is not inserted and the ratchet wheel of small diameter runs idle. When failing in start and trying to rewind the spring, the manual crank is inserted into the rotation shaft of the ratchet wheel of small diameter, to rotate the spring barrel drum and accumulate the pressure in the spring. At an engine start time, the above start ratchet is operated, an energy accumulated in the spring is released to rotate the starter ratchet wheel, thereby to crank and start the engine.

A starter, for example, in Japanese Patent Application Laid-Open (JP-A) No. 2002-285940 interposes a shock absorbing/pressure accumulating means on the way of the power transmission system between a driving unit and a follower. The driving unit is an electric motor as its driving source and a reduction mechanism is formed by a warm jointly fixed to the output rotation shaft of the electric motor and a warm wheel provided on the outer periphery of the spring barrel drum. The above structure is actually the same as that of the above JP-U No. 63-110672. A recoil driving unit is provided on the driving side, separately from the electric motor, and the recoil driving unit includes a rope reel with a recoil rope wound there, which reel is rotated by drawing the recoil rope, a recoiling spring which rotates the rope reel inversely so as to wind up the recoil rope, and a recoiling ratchet mechanism which transmits the rotation of the rope reel to the shock absorbing/pressure accumulating means. The spring barrel drum is designed to rotate only in one direction by a one-way clutch. Owing to this structure, the starter of the JP-A No. 2002-285940 may be referred to as only the combination of the above JP-U No. 63-110672 and the well-known recoil mechanism.

According to the engine starter of the above JP-U No. 63-110672, since the warm gear directly connected to the electric motor is engaged in the warm wheel formed on the outer periphery of the spring barrel drum, hence to rotate the spring barrel drum in one direction, the spring barrel drum is not rotated inversely, but in this power transmission mechanism due to the engagement of the warm gear and the warm wheel, the output axis direction of the electric motor and the rotation driving shaft of the spring barrel drum cross at right angle, and thus for the sake of design, efficiency is poor (about 60%) and the downsizing is limited. According to the engine starter in the JP-U No. 63-110672, when the battery is dead and the electric motor gets out of order, the engine starter itself cannot be operated.

According to the Japanese Patent No. 2573340, on the other hand, the reduction gear mechanism of high reduction gear ratio is arranged between the electric motor and the spring barrel drum, the capacity of motor and the capacity of battery are respectively reduced to less than 1/10 and 1/6 in the cell starter method, and even when a compact battery is mounted, it would not lose a practical use. The reduction ratio of the reduction gear mechanism of high reduction gear ratio is set to remarkable degrees of 1/250 to 1/300. Therefore, it naturally takes a lot of time to rotate the spring barrel drum enough to accumulate a necessary pressure in the spring. In this engine starter, an automatic winding controller of spiral spring is provided, the power accumulating operation of the power accumulating spring is automatically performed by a control circuit of this controller in every starting operation, and the power supply to the motor is stopped by detecting a timer or the winding up of the spring, thereby reducing the waiting time of restart. As a result, the whole device becomes complicated, naturally its maintenance becomes troublesome, and accordingly the cost becomes expensive. Needless to say, the battery is built the device within, and the whole device upsizes so much.

According to the JP-U No. 2-13171, when the electric motor breaks down, the manual crank is operated to rotate the spring barrel drum through the ratchet wheel of small diameter, the spring is rewound to have the accumulated power, the starting ratchet is operated after removing the manual crank, to release the energy accumulated in the spring, hence to rotate the starter ratchet wheel and start the engine. However, during the rotation of the engine, the ratchet wheel of small diameter runs idle. In the JP-U No. 2-13171, since the respective axes of the electric motor, the spring barrel drum, the ratchet wheel of small diameter, and the ratchet claw are in parallel with each other, this extremely limits the downsizing of the engine starter.

In the JP-A No. 2002-285940, since the spring barrel drum is manually driven through the recoil driving mechanism in an emergency, the whole device comes to include the electric motor and its reduction mechanism in addition to the conventional recoiling engine starter, and further, since the reduction mechanism is composed of the warm gear and the warm wheel of the spring barrel drum, the electric motor shaft and the supporting shaft of the spring barrel drum cross at right angle, and therefore, it is difficult to downsize the whole device similarly to the JP-U No. 63-110672.

SUMMARY OF THE INVENTION

In order to solve the above conventional problems, the invention is to provide a compact electric engine starter in which an unnecessary part is eliminated, for the sake of rational design, downsizing and weight saving is improved to a high degree, the weight balance on the both sides of the whole engine becomes even, and further the engine can be started by hand.

The above-mentioned object is achieved by an engine starter having a compact electric motor driven by a battery power, a power accumulating unit which transmits the power of the compact electric motor through a high-speed reduction gear mechanism in a direction of accumulating power, and a power transmission unit which transmits the accumulated power of the power accumulating unit to a crank shaft of an engine, that is the fundamental structure of the invention, in which the battery is arranged outside the starter, the power accumulating unit has a spring and a rotation supporting member for supporting one end of the spring, the rotation supporting member having a first gear on its outer peripheral surface, a second gear is fixed to an output shaft of the high-speed reduction gear mechanism, the first and the second gears are engaged with each other, the power accumulating unit and the power transmission unit are arranged on the same first axis line and the compact electric motor and the high-speed reduction gear mechanism are arranged on the same second axis line parallel to the first axis line, and the second axis line where the compact electric motor is placed is arranged on a straight line, below the first axis line, connecting a gravity center of the whole engine, including peripheral units around a muffler and a carburetor, with the engine starter mounted thereon, and an axis line of the crank shaft.

Here, a spiral spring and a coil spring are used as the spring. When using the spiral spring, a spring barrel drum is used as the rotation supporting member. When using the coil spring as the spring, a general gear may be used as the rotation supporting member. It is preferable that a planetary reduction gear mechanism is used as the high-speed reduction gear mechanism and that a spur gear is used for the first and the second gears by combination with the planetary gear.

According to the preferable mode, it includes a rotation operating mechanism which can rotate an output shaft by hand and set the shaft end of the output shaft free or tight, being positioned on the axis line of the output shaft of the high-speed reduction gear mechanism. The power accumulating unit or the power transmission unit may be provided with a rotation preventing means which usually allows the rotation in a direction of releasing the power of the power accumulating unit or the power transmission unit but prevents the rotation in the direction of releasing the power, so as not to release the spring power accumulated in the power accumulating unit even when a hand is removed from the rotation mechanism at a halt of the electric motor, when having the rotation operating mechanism. When the power transmission unit has a starting pulley connected to the crank shaft through a switching means, it is preferable that the rotation preventing means is composed of a plurality of ratchet teeth formed on the outer periphery of the starting pulley that is one of the components of the power transmission unit and a releasing member for setting the ratchet tooth free or tight.

According to the invention, since the components integrated with the starter are the minimum, the recoil driving unit is eliminated, the battery is arranged outside the starter, and simultaneously, the arrangement of the units accommodated into the starter is designed most efficiently. Assuming the case where the electric motor cannot be driven, manual engine start is enabled in such an emergency. As a result, the whole starter can be downsized extremely, and in order to solve various problems of the Patent Documents 1 to 4, it is needless to say that ultra-compact units are used as the electric motor and the reduction gear mechanism. In addition to the weight saving by eliminating some units such as the battery and the recoil driving unit which have been built in the conventional device as well as the downsizing of the whole starter, the most rational design of most efficient arrangement is adopted in which the weight balance can be kept on the both sides of the engine with the engine starter mounted thereon at every operation of various working machines.

Namely, the battery and the start switch are not mounted on the starter, but they are provided on a handle, an operation unit of the working machine. The first axis line that is the rotation axis line common to the power accumulating unit, the power transmission unit, and the crank shaft is arranged in parallel to the second axis line that is the rotation axis line of the electric motor and the reduction gear mechanism, thereby shortening the measurement of the starter in the direction of the axis line and its orthogonal direction and reducing the arrangement space of these units to a minimum. While, the engine is provided with the auxiliary units around the muffler and the carburetor equally on the both sides of the engine integrally. The gravity center differs between on the muffler side and the carburetor side and the weight on the carburetor is heavier than that on the muffler side. On the other hand, the main body of the engine is substantially symmetric and the gravity center is on the vertical line halving the body.

Therefore, the gravity center of the whole engine is a little deviated toward the carburetor side with the crankshaft as a center. As a result, when the engine is supported on the crank shaft line, when the gravity center in the horizontal direction is ignored, the rotation torque inclining to one of the both sides with the crank shaft as a center always works in the engine so that the straight line connecting the gravity center and the crank shaft may be a vertical line. In order to make the rotation torque zero, the gravity center with the engine starter mounted should be on the vertical line halving the engine main body horizontally and the axis center of the crankshaft may be on the same vertical line ideally. Such arrangements, however, are very difficult because the setting space of the engine starter has various restrictions.

Therefore, the second axis line where the compact electric motor is placed, is arranged on a straight line, below the axis line of the crank shaft, connecting a gravity center of the whole engine, including peripheral units around a muffler and a carburetor, with the engine starter mounted thereon, and the axis line of the crank shaft. The electric engine starter according to the invention is symmetric and the gravity center is on the vertical line including the first axis line and the second axis line halving the engine starter horizontally. By arranging the compact electric motor as mentioned above, the gravity center of the whole engine with the engine starter mounted thereon is moved toward the straight line. This can improve the balance on the both sides of the whole engine with the starter mounted thereon, the power in a direction of straining the hand hardly works, and the fatigues occurring during the operation of the working machine caused by the unbalance are not accumulated, which enables the stable work for a long time. Needless to say, further downsizing is realized according as the number of the components is reduced.

When using the planetary reduction gear mechanism as the high-speed reduction gear mechanism, the axis line of the input unit and the axis line (second axis line) of the output shaft can be arranged in one line. This is arranged parallel to the first axis line, the first and the second gears are formed in the shape of the spur gear, the first gear of the power accumulating unit is engaged in the second gear of the reduction gear mechanism, and the first axis line and the second axis line are arranged on a same plane surface, hence to reduce the space exclusive for the units to a minimum degree. At the same time, when the rotation operating mechanism is provided with a removable unit provided on the shaft end portion of the output shaft of the reduction gear mechanism and a rotation operating member which sets the removable unit of the shaft end free or tight while moving forward and backward on the axis line in an emergency, it is not necessary to provide even a driving mechanism such as a ratchet wheel and a recoil driving mechanism rotated by the manual crank, which contributes to the further downsizing.

The planetary reduction gear mechanism is easily downsized as the high-speed reduction gear mechanism, and in the case of this invention, the reduction ratio is not set so largely at 1/250 to 1/300 like the Japanese Patent No. 2573340 but set at around 1/50 at the best by combination with the first gear, hence to shorten the starting time of the engine, namely, the time required for the power accumulating unit to get a necessary accumulated power.

As the rotation preventing means, a combination of a plurality of ratchet teeth formed on the outer periphery of the starting pulley connected through a switching means such as a centrifugal clutch and a releasing member to be engaged in the ratchet tooth is used, thereby making the operation of the rotation preventing means accurately and easily. When the above rotation operating mechanism is composed of the removal unit provided on the shaft end of the output shaft of the high-speed reduction gear mechanism and the rotation operating member which sets the removable unit of the shaft end free or tight while moving forward and backward on the axis line, the rotation operating member can be pushed into or pulled from the starter toward the removable unit of the shaft end externally. Further, since the distal end can be attached to the removable unit of the shaft end and the rotation operating member is rotated in a direction of accumulating the power by the power accumulating unit, the output shaft of the high-speed reduction gear is rotated to accumulate the power in the power accumulating unit. Here, although the electric motor rotates simultaneously, because of the high-speed reduction gear ratio, the rotation is a little and the rotation torque is small, and the output shaft of the high-speed reduction gear mechanism can be easily rotated by hand.

According to the above structure, normally an engine starts by activating the electric motor, to rotate the power accumulating unit in a direction of accumulating the power through the high-speed reduction gear mechanism and the second gear, and when the accumulated power exceeds the maximum load enough to start the engine, the engine automatically starts. When a battery is dead and the electric motor doesn't work, even when the output shaft of the reduction gear mechanism is operated manually by using the rotation operating mechanism, the power will be accumulated in the power accumulating unit and when the accumulated power exceeds the maximum load of the engine, the engine will start. Here, when the one-way rotation preventing means is provided in the power accumulating unit or the power transmission unit, when the rotation operating mechanism is operated, the output shaft of the high-speed reduction gear mechanism is rotated in a direction of accumulating the power by the power accumulating unit while preventing the rotation in the direction of releasing the power in the power accumulating unit or the power transmission unit, hence to accumulate a necessary power in the power accumulating unit. When a necessary power has been accumulated, the rotation operating mechanism is released, and the rotation preventing means is operated toward the releasing direction, hence to allow the rotation of the power accumulating unit or the power transmission unit. Simultaneously with the allowance, the power in the power accumulating unit is released, hence to start the engine.

DESCRIPTION OF THE PREFERRED EMBODIMENTS

Hereinafter, embodiments of the invention will be described in detail with reference to the accompanying drawings.

Figure 1:
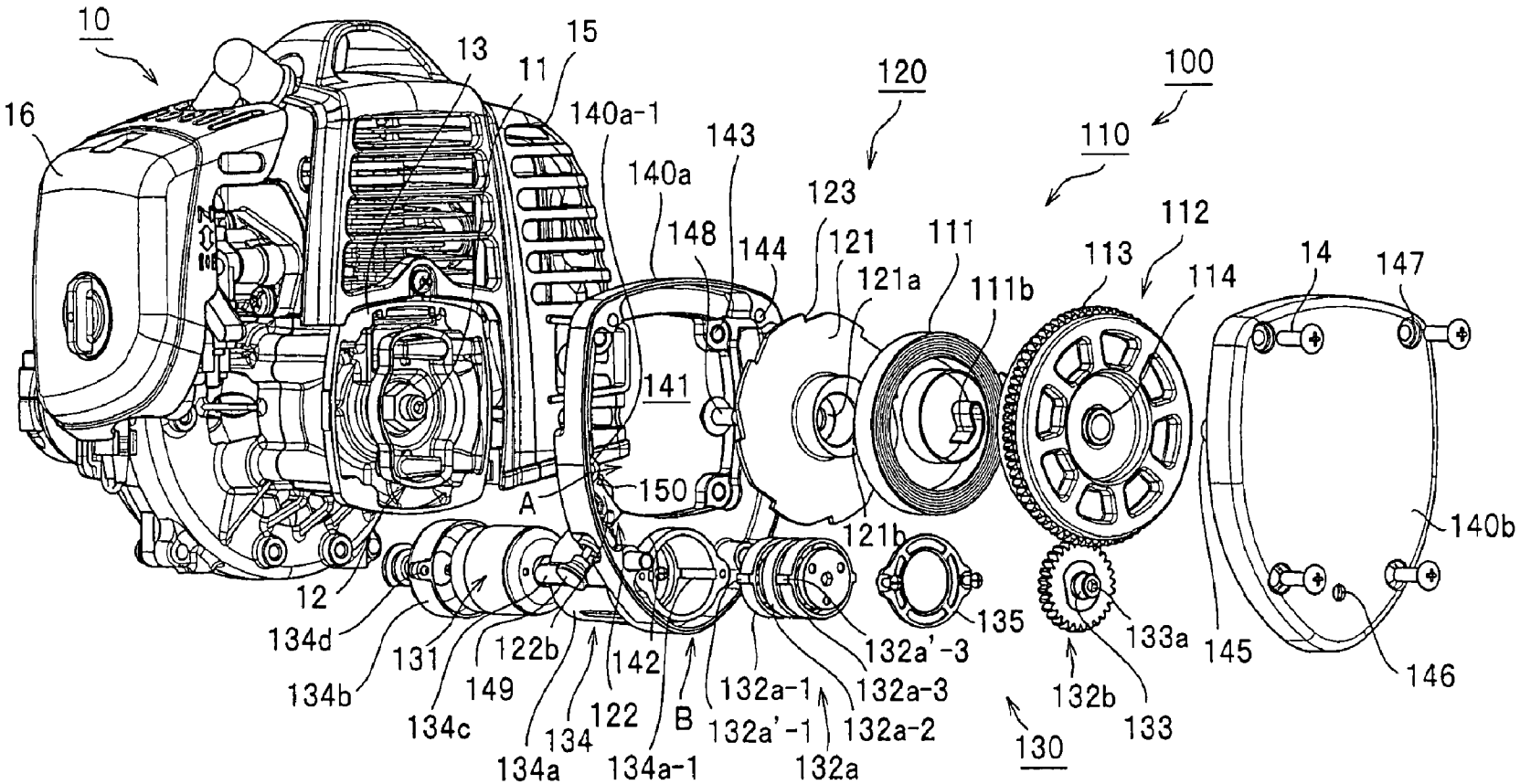
FIG. 1 is an exploded view of the electric engine starter according to the first embodiment of the invention and the engine at their assembly stage.

FIG. 1 is an exploded view of an electric engine starter showing the first embodiment of the invention and an internal combustion engine at a stage of their assembly. FIG. 2 to FIG. 5 are views for use in describing the arrangement and the structure of each component of the engine starter in the first embodiment. The engine starter 100 of the invention is used for a compact air-cooled 2-cycle gasoline engine and the starter 100 is arranged near by an input end of a crankshaft 11 of the internal combustion engine 10.

The engine starter 100 includes a power accumulating unit 110, a power transmission unit 120, and an electric driving unit 130, and they are integrated together and accommodated in a single case 140. The case 140 has a rectangular-shaped first space A for accommodating the power accumulating unit 110 and the power transmission unit 120 in the upper half in FIG. 1 and an inverted triangular-shaped second space B narrowing downward for accommodating the driving unit 130 in its lower half in FIG. 1. The case 140 is formed by the equally divided structure of the first case 140*a* on the engine side and the second case 140*b* on its opposite side.

The upper half portion of the first case 140*a* on the side of engine is formed as a substantially rectangular window 141, and a reduction gear insertion hole 142 for inserting a high speed reduction gear mechanism 132 described later that is one of the components of the electric driving unit 130 is formed in the middle of the lower half portion. Bolt insertion holes 143 for fixing the first case 140*a* to the engine 10 are formed at the four corners on the inner side of the rectangular window 141 and screw holes 144 for combining the first case 140*a* with the second case 140*b* are formed at four positions; on the upper two corners and the lower two corners of the frame of the rectangular window 141. On the other hand, a shaft 145 is protruded toward the direction of the engine from the middle of the bottom inner surface which forms the first space A of the second case 140*b* on the opposite side of the engine, and a wrench insertion hole 146 for communicating with the inner space is formed on the back wall portion forming the second space B at the lower position perpendicular to the shaft 145 correspondingly to the center of the reduction gear insertion hole 142. Bolt insertion holes 147 are respectively formed on the second case 140*b* at the positions corresponding to the screw holes 144 of the first case 140*a*.

Figure 2:
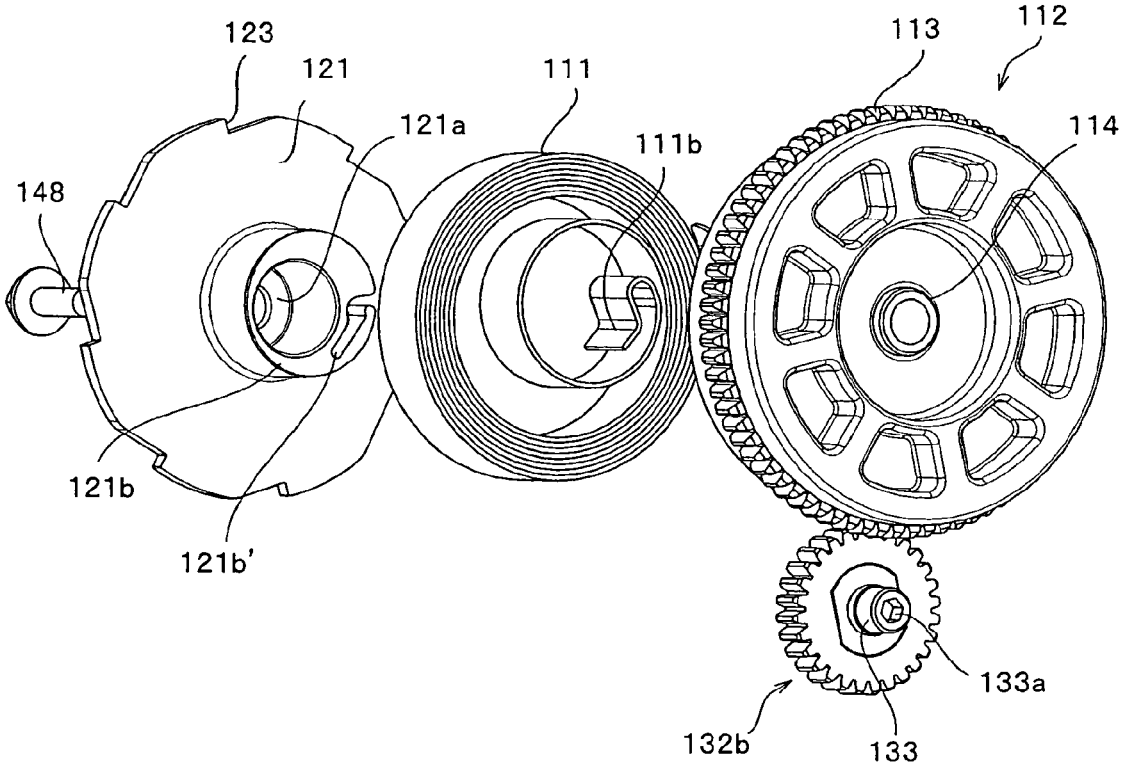
FIG. 2 an exploded perspective view showing the power accumulating unit, the power transmission unit, and one of the electric driving units of the electric engine starter in a magnified way.

The power accumulating unit 110 includes a spring 111 and a spring barrel drum 112, as illustrated in FIG. 1 and FIG. 2, and a spur gear 113 is formed on the outer peripheral surface of the spring barrel drum 112 at its half portion. A through hole 112*a* is formed at the center of the spring barrel drum 112, the outer wheel of the one-way clutch 114 of bearing shape is embedded in the through hole 112*a*, and the shaft 145 is fixedly attached to the inner wheel of the one-way clutch 114. Further, a spring housing space, not illustrated, is formed on the side of the engine of the spring barrel drum 112 and a fixing groove of an outer end, not illustrated, for fixing the outer end 111*a* of the spring 111 is formed on one portion of the peripheral surface of the spring housing space.

Figure 6:
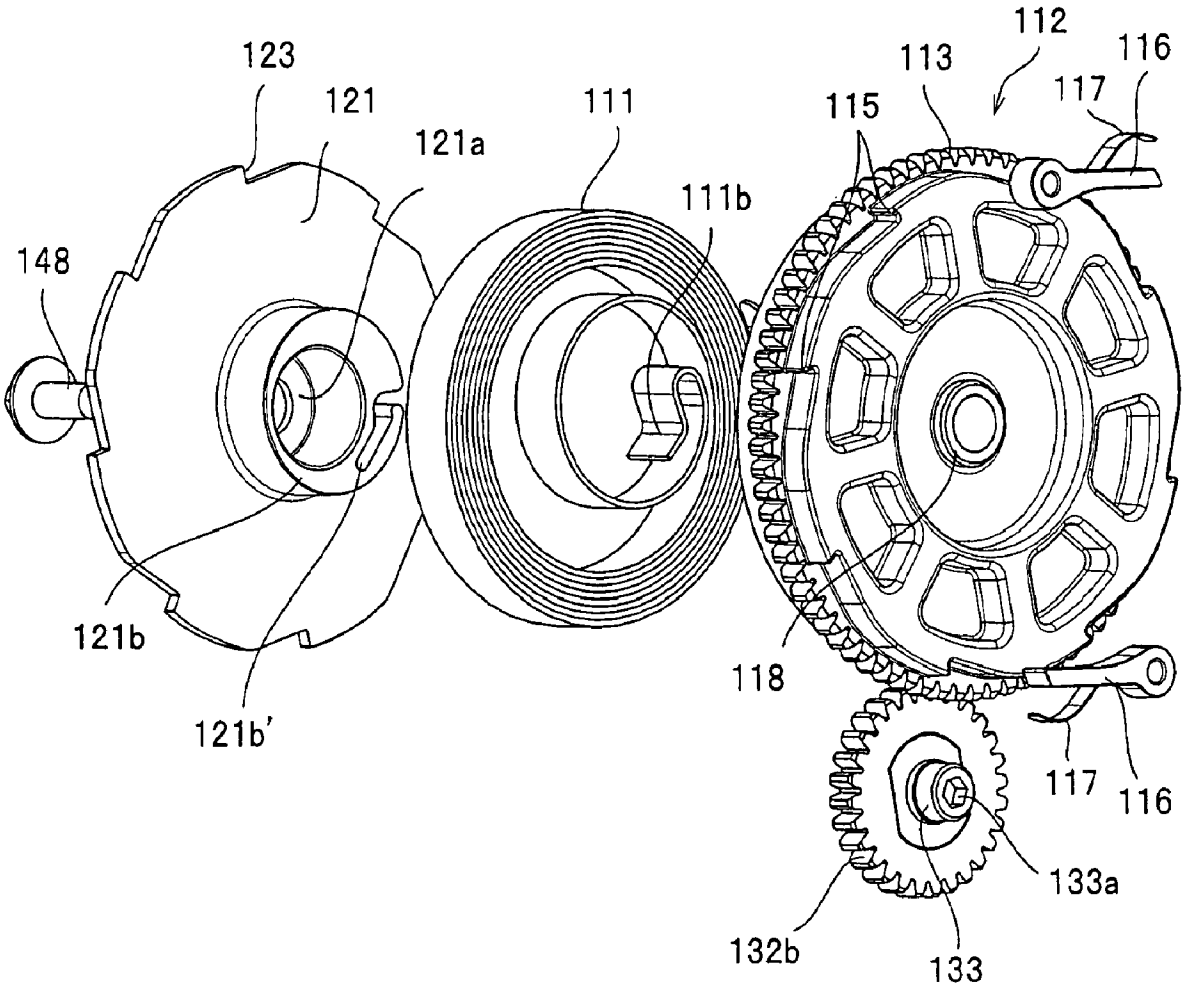
FIG. 6 is an exploded perspective view showing the important portion of the variation example in the first embodiment in a magnified way.

In the first embodiment, as mentioned above, although the spring barrel drum 112 is enabled to rotate in one direction by the one-way clutch 114 of bearing shape, another ratchet tooth 115, instead of the one-way clutch 114, may be formed on the outer peripheral surface of the spring barrel drum 112, besides the spur gear 113, as illustrated in FIG. 6, and the spring barrel drum 112 may be enabled to rotate in one direction even when a ratchet claw 116 to be engaged in the ratchet tooth 115 is supported rotatably on one portion of the second case 140*b*. At this time, the ratchet claw 116 is always urged toward the direction to be engaged in the ratchet tooth 115 by a spring material 117 mounted on the second case 140*b*. In this case, the spring barrel drum 112 is supported rotatably by the shaft 145 through a flat bearing 118.

The power transmission unit 120 is formed by a starting pulley 121 and a releasing member 122 which is free or tight to the starting pulley 121, as illustrated in FIG. 2 to FIG. 5 indicating one portion of FIG. 1 magnified. A loose hole 121*a* for loosely inserting the shaft 145 protruding from the second case 140*b* is formed in the center of the starting pulley 121 and as illustrated in FIG. 2, a spring end fixing unit 121*b* protruding toward the spring barrel drum 112 in a way of surrounding the loose hole 121*a* is formed in the center of the starting pulley 121 on the opposite side of the engine. An inner end fixing groove 121*b* which fixedly attaches the inner end 111*b* of the spring 111 is formed on the spring end fixing unit 121*b*. A screw hole, not illustrated, is formed on the distal end of the shaft 145, a set screw 148 is screwed into the screw hole at a point of finishing the assembly, and the power accumulating unit 110 and the starting pulley 121 are accommodated into the second case 140*b*. The axis line of the shaft 145 is a first axis line in the invention.

Figure 5:
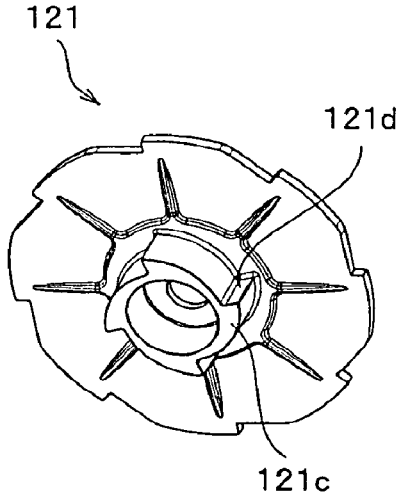
FIG. 5 is a perspective view showing the driving wheel of the power transmission unit from the front side.

An engaged protruding portion 121*c*, having the ratchet tooth 121*d* on the peripheral surface to be engaged in a catching claw that is one element of the centrifugal clutch mechanism mounted on a fan, not illustrated, integrated with the crank shaft 11 of the engine 10, as illustrated in FIG. 5, is protruded in the center of the starting pulley 121 on the side of the engine. Although the engaged protruding portion 121*c* is at a halt, being engaged in the catching claw 12 mounted on the crank shaft 11, while receiving the energy in a releasing direction occurring in the process of accumulating a spring force in the spring 111 through rotation of the spring barrel drum 112, until the power of the spring exceeds the maximum load of the engine, the engaged protruding portion 121*c* as being engaged with the catching claw 12 starts rotating and makes the engine start when the accumulated power in the spring 111 exceeds the maximum load. When the rotation of the engine comes into a constant state, the catching claw 12 is released from the engagement with the engaged protruding portion 121*c* of the starting pulley 121 owing to the centrifugal power, and the rotation of the engine is maintained.

The ratchet teeth 123 are formed at predetermined intervals on the outer periphery of the starting pulley 121 and the whole starting pulley 121 is formed as a ratchet wheel. One end 122*b* of the releasing member 122 is supported rotatably by a boss 140*a*-1 of the first case 140*a*, a push button 149 operates the rotation of its distal end 122*a*, to set the outer peripheral ratchet tooth 123 of the starting pulley 121 free of tight, thereby enabling or disabling the rotation of the starting pulley 121. The distal end 122*a* of the releasing member 122 is urged toward the direction of releasing itself from the ratchet tooth 123 by the spiral screw 150 and the distal end 122*a* can be engaged in the ratchet tooth 123 only by rotating the one end 122*b* against the spiral screw 150. The releasing member 122 and the ratchet tooth 123 of the starting pulley 121 correspond to the rotation preventing means in the invention.

Figure 4:
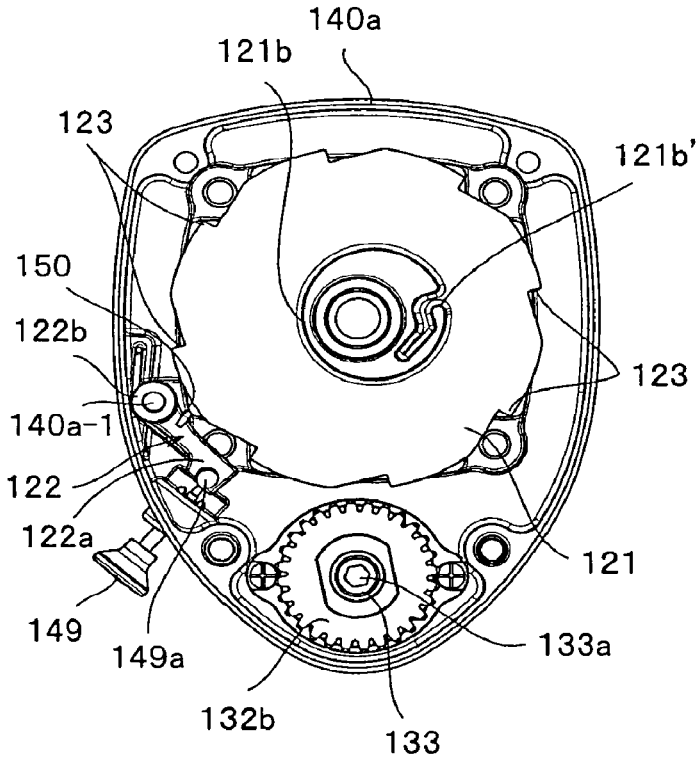
FIG. 4 is a front view of a not-engagement state of the releasing means and the power transmission unit viewed from the back side in FIG. 1.

According to the embodiment, in order to rotate the distal end 122*a* of the releasing member 122 against the urged force, as illustrated in FIG. 4 and FIG. 5, a ball portion 149*a* of a pin end of the push button 149 mounted on the outer peripheral portion of the first case 140*a* is embedded in the distal end 122*a* of the releasing member 122, and the releasing member 122 is rotated toward the ratchet tooth 123 against the force of the spiral screw 150 by pushing the push button 149. According to this pushing operation, the push button 149 is locked by a locking means, not illustrated, and by pulling the push button 149, the lock is released and the releasing member 122 is rotated toward a direction of releasing the mesh with the ratchet tooth 123.

Further, the releasing member 122 is fixed to the peripheral wall portion of the first case 140*a* by the force of the spiral screw 150.

The electric driving unit 130 is formed by an ultra-compact direct current electric motor 131 and a high speed reduction gear mechanism 132 combined with the output shaft of the electric motor 131, a high speed rotation of the electric motor 131 is reduced through the high speed reduction gear mechanism 132 and transmitted to the spring barrel drum 112. The high speed reduction gear mechanism 132 is formed by a small-sized planetary gear mechanism 132*a* and the spur gear 132*b* fixed to the output shaft of the planetary gear mechanism 132*a*. As the reduction gear mechanism 32, a combination of the planetary gear mechanism 132*a* and the spur gear 132*b* is used, and therefore, the input unit and the output shaft can be arranged on the same axis line that is the second axis line of the invention, which enables the axis line to be parallel with the shaft 145 protruding from the second case 140*b* toward the engine. This makes it possible to eliminate the recoil mechanism completely, arrange the battery which has been hitherto arranged in the lower portion of the power accumulating unit 110 and the power transmission unit 120, in the outside of the case 140, for example, in an operation handle, not illustrated, of the working machine. As a result, the electric driving unit 130 is arranged in the empty space being formed, hence to make it possible to shorten the length of the axis line of the case 140 and shorten the lateral width of the case 140 to the minimum degree.

Figure 3:
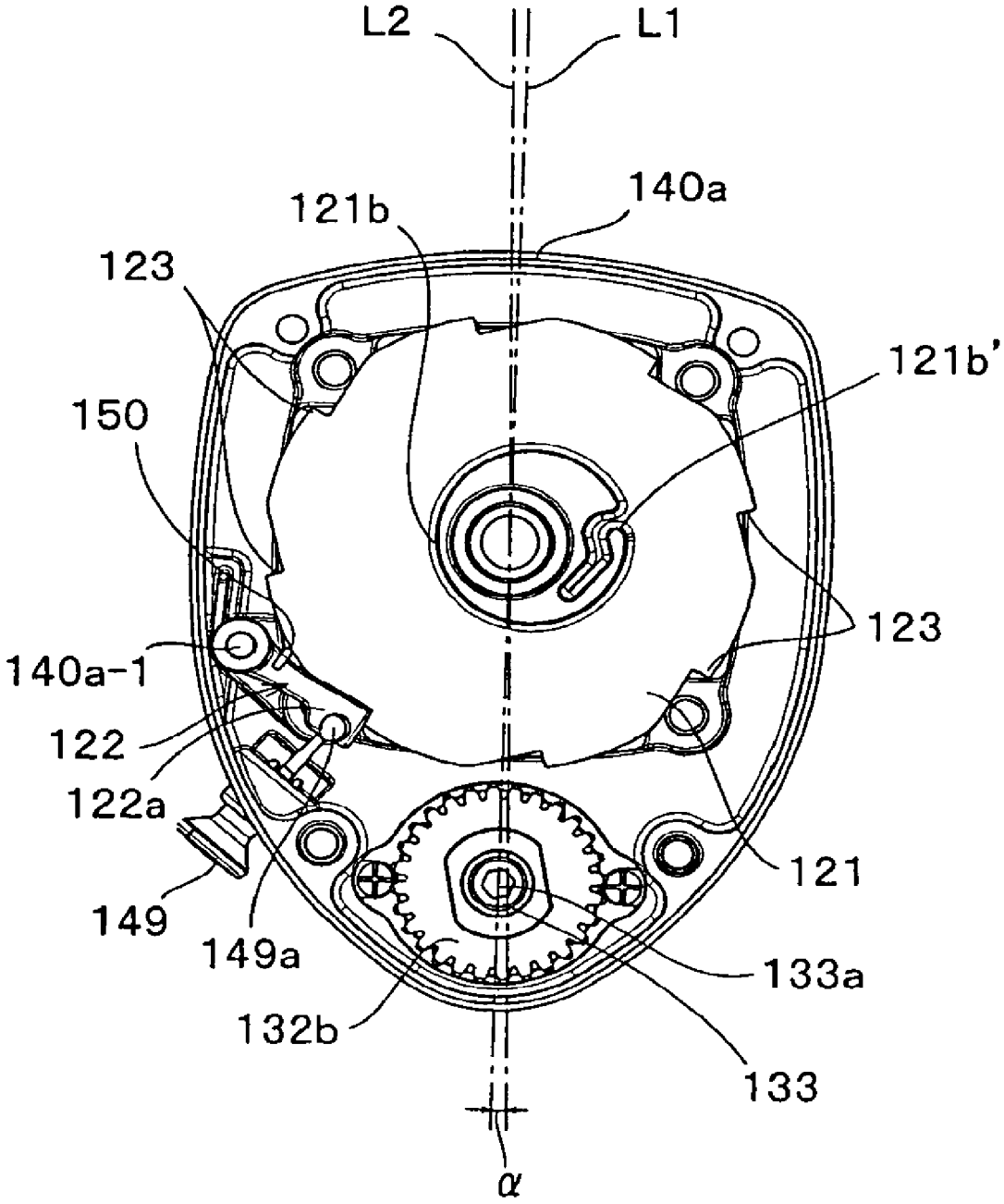
FIG. 3 is a front view of an engagement state of the releasing means and the power transmission unit viewed from the back side in FIG. 1.

In this embodiment, the axis line of the electric driving unit 130 is arranged in the lower portion perpendicular to the shaft 145. Strictly speaking, the axis center of the electric driving unit 130 is arranged at a position a little deviated from a line perpendicular to the axis center of the shaft 145. Namely, a line L1 connecting the axis center of the electric driving unit 130 and the axis center of the shaft 145 is not located at the vertical line L2 but rotated around the shaft 145 for a smallest angle $\alpha$, as illustrated in FIG. 3. Specifically, the setting position of the engine starter 100 is a little inclined toward the engine 10 itself and the engine starter 100 is set at the engine 10. FIG. 3 shows the smallest angle $\alpha$ magnified for the sake of easy understanding, but it is actually too small to be visible.

As mentioned above, the rotation axis line of the catching claw 12 of the centrifugal clutch mechanism mounted on the crank shaft 11 of the engine 10 and the rotation center of the starting pulley 121 of the power transmission unit 120 are on the first axis line in agreement. While, the axis line (second axis line) of the electric driving unit 130 may be arranged anywhere near the first axis line if only there is a space. In fact, when taking the downsizing of a device into consideration, the setting position of the engine starter, especially, its electric motor will be naturally definite.

The engine 10 is provided with a muffler 15 and a carburetor 16, by way of example, symmetrically on the both sides of the crank shaft 11, as illustrated in FIG. 1, additionally to the main body of the engine. The center of the gravity on the side of the muffler 15 is different from that on the side of the carburetor 16 and therefore, the center of the gravity of the whole engine 10 is a little deviated toward the side of the carburetor 16. This small movement of the gravity center causes the generation of the rotation torque that weighs the engine toward the vertically lower portion of the gravity center (in a direction of gravitation), and when a user works by carrying the working machine, he or she may receive a force straining his or her hand at the operation. During working, the user tries to maintain the working position against this force, which fatigues him or her very much, and accumulation of the fatigues makes it difficult to work for a long time. The engine starter 100 of the invention, however, has the symmetrical figure and structure, although it has a little deviation as mentioned above, and the position of the gravity center may be considered to be on the vertical line which almost halves the body.

According to the embodiment, the axis line (second axis line) of the electric driving unit 130 is arranged in the vertically lower portion of the axis line (first axis line) of the shaft 145 in parallel, as mentioned above. By arranging the compact electric motor 131 like this, the gravity center of the whole engine with the engine starter 100 mounted thereon is moved to the direct line connecting the center of the crank shaft 11 and the shaft center of the electric motor 131, and it is moved a little downwardly from the position of the gravity center of the engine 1 with no engine starter 100 mounted thereon. Therefore, the balance of the whole engine on the both sides with the engine starter 100 mounted thereon is improved, the rotation torque straining the user's hand at the working time is little generated, and fatigue during the operation of the machine caused by the unbalance can be reduced.

The planetary gear mechanism 132*a* according to the embodiment has first to third inner gears 132*a*-1 to 132*a*-3 that are ring-shaped sun gears, and the planetary gear mechanism 132*a* is to be fixedly accommodated into the motor housing case 134 together with the electric motor 131. A plurality of projections 132*a*'-1 to 132*a*'-3 extending in parallel to the rotation shaft are provided on the outer peripheral surface of the first to third inner gears 132*a*-1 to 132*a*-3, and the same number of fixing grooves 134*a*-1 for fixing the projections 132*a*'-1 to 132*a*'-3, which extends in parallel to the axis line, are formed on the inner peripheral surface of the motor housing case 134 at the position corresponding to the projections 132*a*'-1 to 132*a*'-3.

In the embodiment, the motor housing case 134 is formed in a cylindrical body having the bottom with an open end on the opposite side of the engine, and divided into a cylindrical main body 134*a* and a bottom 134*b*. Projections 134*c* and 134*d* extending in parallel to the axis line are provided on the outer peripheral surface where the respective fixing grooves 134*a*-1 of the cylindrical main body 134*a* and the bottom 134*b* are formed, a screw hole is formed on the projection 134*d* of the bottom 134*b*, and a bolt insertion hole is formed on the projection 134*c* of the cylindrical main body 134*a*. The projections 132*a*'-1 to 132*a*'-3 of the planetary gear mechanism 132*a* are attached to the fixing grooves 134*a* of the motor housing case 134 having the above structure, hence to accommodate the electric motor 131 and the planetary gear mechanism 132*a* fixedly. The motor housing case 134 accommodating the electric motor 131 and the planetary gear mechanism 132*a* is embedded in the motor embedding opening 142 formed in the first case 140*a* and supported. At this time, the electric motor 131 and the planetary gear mechanism 132*a* accommodated into the motor housing case 134 are fastened through bolts and nuts, not illustrated, by a fixing frame 135 with the output shaft of the planetary gear mechanism 132*a* exposed to the outside. In this manner, the spur gear 132*a* is fixed to the distal end of the output shaft of the planetary gear mechanism 132*a* fixedly accommodated into the motor housing case 134.

According to the embodiment, the reduction ratio between the compact electric motor 131 and the spring barrel drum 112 is set at 1/50. The reduction ratio between the spur gear 132*b* fixed to the output shaft of the planetary gear mechanism 132*a* and the spur gear 113 formed on the outer peripheral surface of the spring barrel drum 112 is set at 1/2.5. Therefore, the reduction ratio of the planetary gear mechanism 132*a* is set at 1/20. An engaged portion 133*a* to be engaged in, for example, a hexagonal wrench, not illustrated, is formed on the output shaft 133 of the planetary gear mechanism 132*a*, namely, the end portion of the supporting shaft of the spur gear 132*b*, and the center of a wrench insertion hole 146 formed on the back wall of the second case 140*b* is located on its axis line.

In order to accommodate the components according to thus constituted embodiment into the case 140 and to assemble them, the shaft 145 of the second case 140*a* is fixedly inserted into the through hole 112*a* of the spring barrel drum 112 with the one-way clutch 114 attached thereto. Here, the outer end of the spring 111 is fixed to the outer end fixing groove, not illustrated, formed on the peripheral wall of the spring housing space of the spring barrel dram 112. Next, the inner end of the spring 111 is fixedly attached to the inner end fixing groove 121*b*' of the spring end fixing unit 121*b* formed in the center of the starting pulley 121. Then, the shaft 145 of the second case 140*a* is loosely inserted into the loose hole 121*a* penetrating the spring end fixing unit 121*b*, and thereafter, the setscrew 147 is screwed into the screw hole of the distal end of the shaft 145, hence to finish assembling the spring barrel drum 112 and the starting pulley 121 within the second case 140*b*.

When assembling the electric driving unit 130 within the case 140, the electric motor 131, the planetary gear mechanism 132*a* and the spur gear 132*b* of the reduction gear mechanism 132 are previously set up as an assembly. The projections 132*a*'-1 to 132*a*'-3 formed on the outer peripheral surface of the planetary gear mechanism 132*a* of this assembly are inserted into the inner fixing grooves 142*a* of the reduction mechanism embedding hole 142 formed on the first case 140*a* and supported fixedly. Thereafter, it is fastened to a crank case 13 through the four bolt insertion holes 143 by the bolts 14 formed at the four corners of the rectangular window 141 of the first case 140*a*. At the same time, the electric motor 131 is arranged at a predetermined position of the crankcase 13 and fixed there.

Thus, after fixing the first case 140*a* together with the electric driving unit 130 to the crank case 13, the bolt 14 is screwed into the screw hole 144 of the first case 140*a* through the screw insertion hole 147 of the second case 140*b*, and as mentioned above, the second case 140*b* with the power accumulating unit 110 and the power transmission unit 120 assembled there is integrally attached to the first case 140*a*. When attaching the second case 140*b* to the first case 140*a*, the other rotative end 122*c* of the releasing member 122 is attached to the outer ratchet tooth 123 of the starting pulley 121. When the releasing member 122 is pivoted by the boss 140*a*-1, its distal end 122*c* is urged in a direction of not being engaged in the ratchet tooth 123 unless the end portion 122*b* of the releasing member 122 is operated by the screw spring 150.

In the electric engine starter 100 according to the embodiment having the above structure, as mentioned above, the recoil driving unit and the battery are eliminated from the case 140 similarly to the conventional art, the spring barrel drum 112 accommodating the spring 111 of the power accumulating unit 110 and the starting pulley 121 of the power transmission unit 120 are supported on the same shaft 145, only the electric motor 131 that is the electric driving unit 130 and the planetary gear mechanism 132*a* and the spur gear 132*b* forming the reduction gear mechanism 132 are arranged on the axis line parallel to the shaft 145 at the lower position perpendicular to the shaft 145, and ultra-compact ones are used as the electric motor 131 and the planetary gear mechanism 132*a*. Therefore, they are accommodated in the case 140 extremely compactly. As a result, the case 140 itself, or the whole starter can be extremely downsized.

When the battery is charged, turning on a switch provided on, for example, a handle starts the rotation of the electric motor 131, so as to start the engine 10 by the starter 100, and then, the high speed reduction gear mechanism 132 composed of the planetary gear mechanism 132*a* and the spur gear 132*b* rotates the spring barrel drum 112 in a direction of accumulating the power of the spring 111 at the reduction ratio of 1/50. At this point, the releasing member 122 is not engaged in the starting pulley 121 of the power transmission unit 120, but only the catching claw 12 mounted on the crankshaft 11 is just engaged in the engaged protruding portion 121*c* of the starting pulley 121.

Here, in the process of rotating the spring barrel drum 112 and accumulating the power in the spring 111, the force of releasing the accumulated power works on the spring 111, hence to entering the process of rotating the crank shaft 11 and compressing the engine 10 through the catching claw 12. The crankshaft 11, however, cannot be rotated further before the sufficient power has been accumulated in the spring 111 so as to exceed the maximum load in the compression process. When the spring 111 has fully accumulated the power enough to exceed the maximum load in the compression process of the engine 10, a force for releasing the accumulated power of the spring 111 becomes so stronger that the starting pulley 121 rotates the crank shaft 11 through the catching claw 12, ignites the engine 10, and starts the operation. When the rotation of the engine 10 comes into a constant operation, the catching claw 12 is removed from the engaged protruding portion 121*c* of the starting pulley 121 owing to its centrifugal force, hence to keep the rotation of the engine. The time required for starting the engine is very short and almost the same as the staring time by the usual cell starter in a car because the reduction ratio of the reduction gear mechanism is set relatively small.

The above is the starting procedure of the engine starter 100 in its normal state. According to the invention, when the electric motor 131 cannot be driven because the battery is dead due to some reasons or because of the failure of the motor itself, the engine 10 can be started manually. According to the embodiment, in the above emergency, at first, the push button 149 is pushed, to make the releasing member 122 into engagement in the ratchet tooth 123 of the starting pulley 121 against the urged force of the releasing member 122. After confirming this engagement, for example, the hexagonal wrench, not illustrated, is inserted into the wrench insertion hole 146 formed on the back surface of the case 140 in FIG. 1, to be engaged in the engaged portion 133*a* formed on the end of the output shaft 133 of the reduction gear mechanism 132. Next, by rotating the hexagonal wrench, the spur gear 132*b* of the reduction gear mechanism 132 is rotated, to rotate the spring barrel drum 112 in a direction of accumulating the power. At the same time, the compact electric motor 131 is to be rotated a little. Though the rotating operation of the hexagonal wrench is performed by hand, since the reduction gear mechanism 132 is interposed between the compact electric motor 131 and the spring barrel drum 112, the rotation torque of the compact electric motor 131 is a little and there is no problem on the operation.

At the operating time of the wrench, since the above releasing member 122 is engaged in the starting pulley 121, no power is transmitted between the starting pulley 121 and the crankshaft 11. As a result, the wrench operation can be performed intensively at ease until the spring 111 has fully accumulated the power. When the spring 111 has accumulated the power enough to start the engine, the hexagonal wrench is removed from the wrench insertion hole 146 of the case 140 by releasing the engagement with the supporting shaft end of the spur gear 132*b*, and the push button 149 is pushed to remove the releasing member 122 from the ratchet tooth 123 of the starting pulley 121. At this point, since the spring 111 has accumulated the power enough to start the engine 10, the engine starts rotation in the instant of releasing the engagement.

The power accumulating unit 110 is formed by the spring 111 and the spring barrel drum 112, as illustrated in FIG. 1 and FIG. 2, and the spur gear 113 to be continued in a peripheral direction is formed on the half of the outer peripheral surface of the spring barrel drum 112. The through hole 112*a* is formed in the center of the spring barrel drum 112, the outer wheel of the one-way clutch 114 of the bearing shape is closely attached to the through hole 112*a*, and the shaft 145 of the second case 140*b* is loosely attached to the inner wheel of the one-way clutch 114. The spring housing space, not illustrated, is formed in the spring barrel drum 112 on the side of the engine, and the outer end fixing groove, not illustrated, for fixing the outer end 111*a* of the spring 111 is formed on one portion of the peripheral wall of the spring housing space.

In the first embodiment, although the spring barrel drum 112 is designed to be rotatable only in one direction by the one-way crutch 111 of the bearing shape, as mentioned above, for example, another ratchet tooth 115, instead of the one-way clutch 114 may be formed on the outer peripheral surface of the spring barrel drum 112, besides the spur gear 113, as illustrated in FIG. 6, and the ratchet claw 116 to be engaged in the ratchet tooth 115 may be rotatively supported on one portion of the second case 140*b*, in order to allow the spring barrel drum 112 to rotate only in one direction. Here, the ratchet claw 116 is similarly urged toward the direction of being engaged in the ratchet tooth 115 by a spring member 117 mounted on the second case 140*b*. In this case, the spring barrel drum 112 is rotatively supported by the shaft 145 through the ordinary flat bearing 118.

Figure 7:
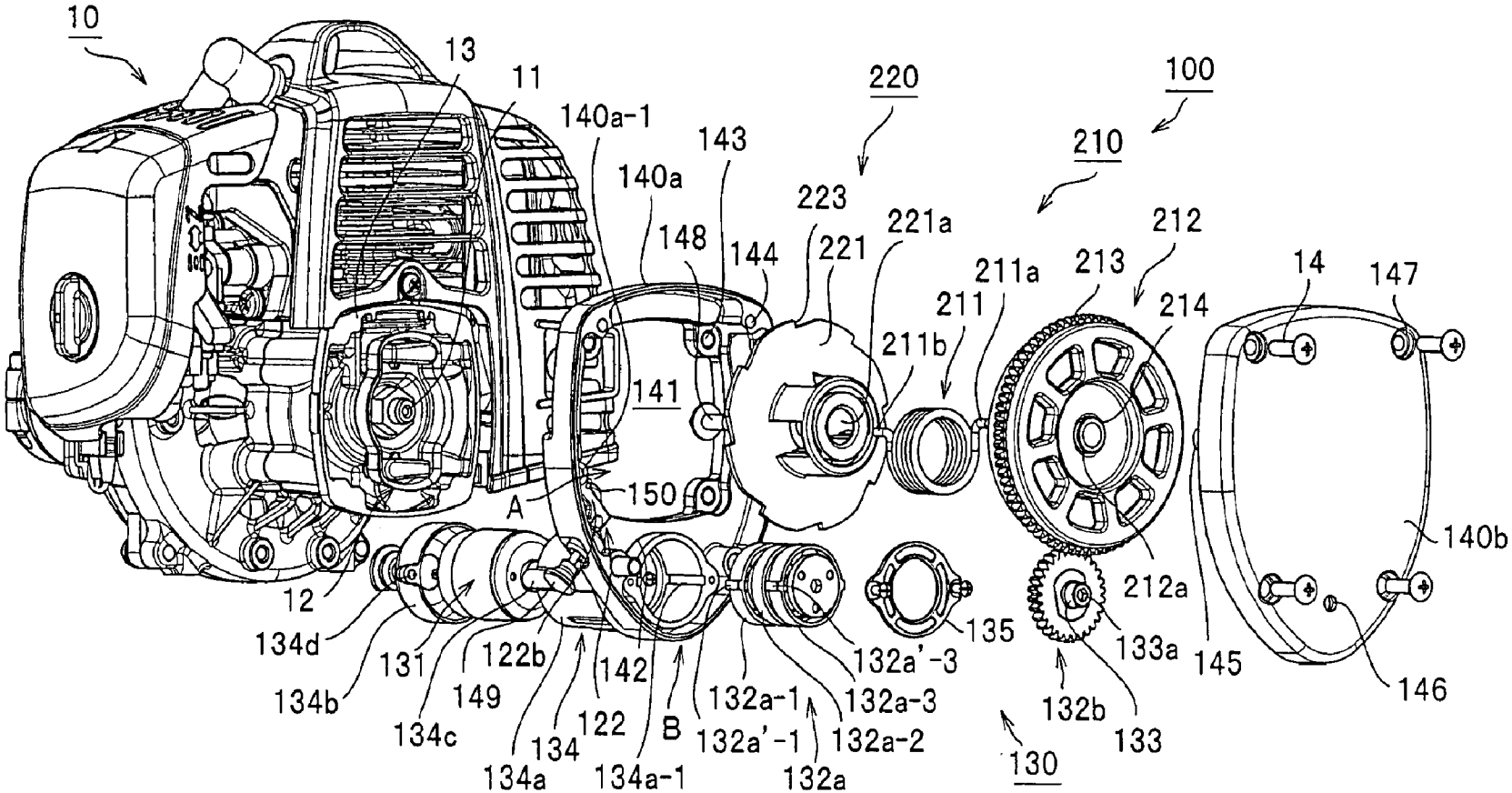
FIG. 7 is an exploded view of the electric engine starter according to the second embodiment of the invention and the engine at their assembly stage.
Figure 8:
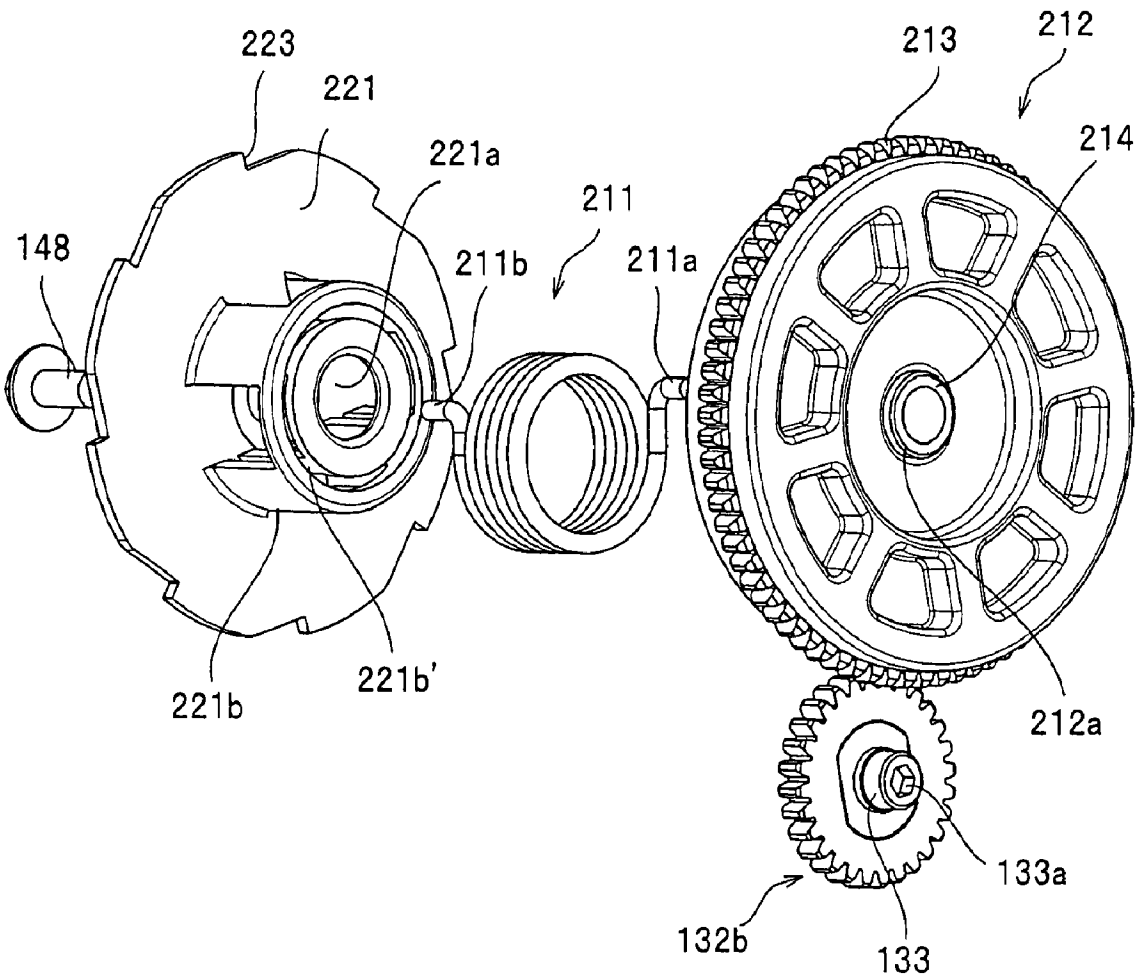
FIG. 8 is an exploded perspective view showing the power accumulating unit, the power transmission unit, and one of the electric driving units of the electric engine starter in a magnified way.
Figure 9:
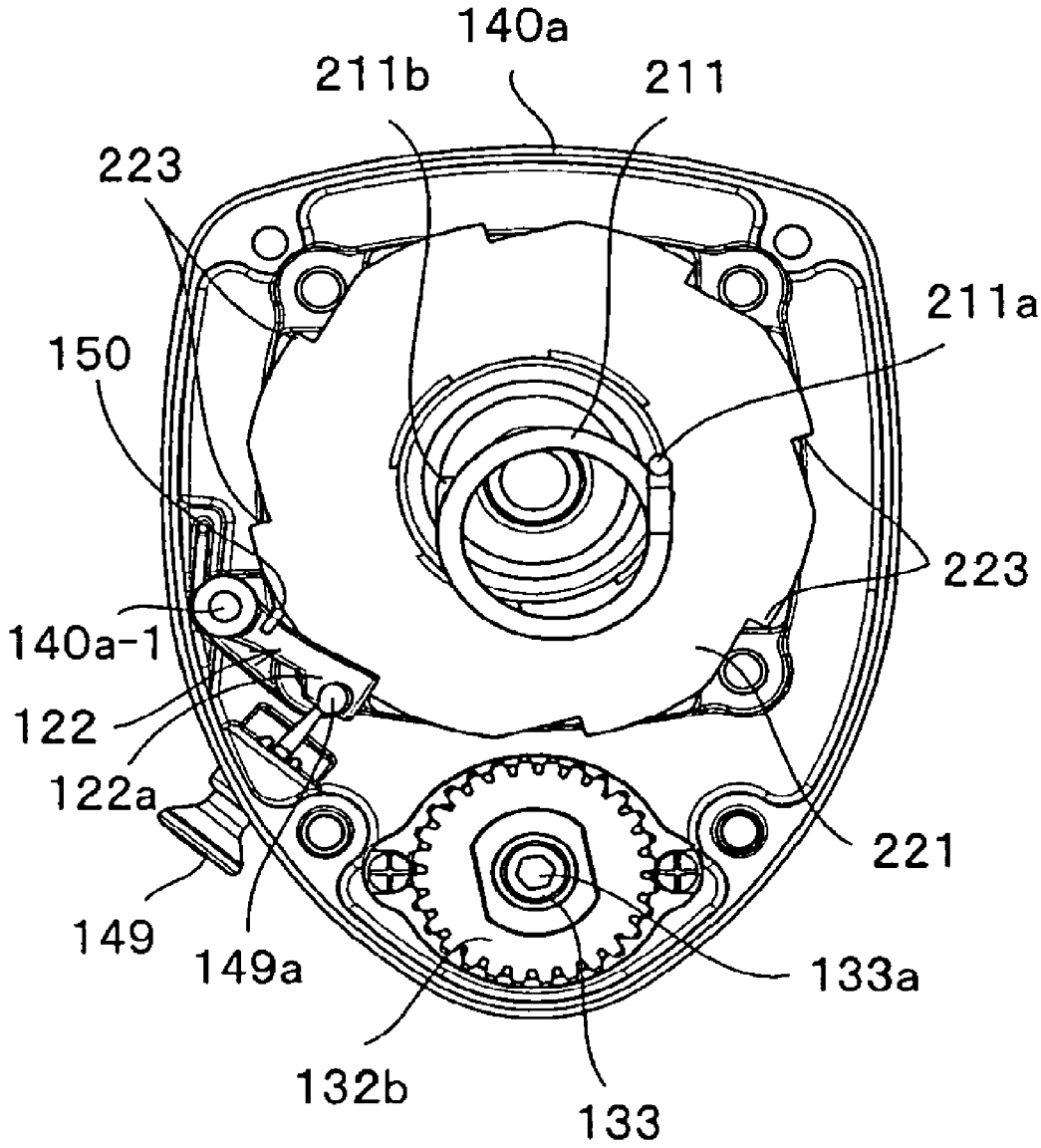
FIG. 9 is a front view of an engagement state of the releasing means and the power transmission unit viewed from the back side in FIG. 7.
Figure 10:
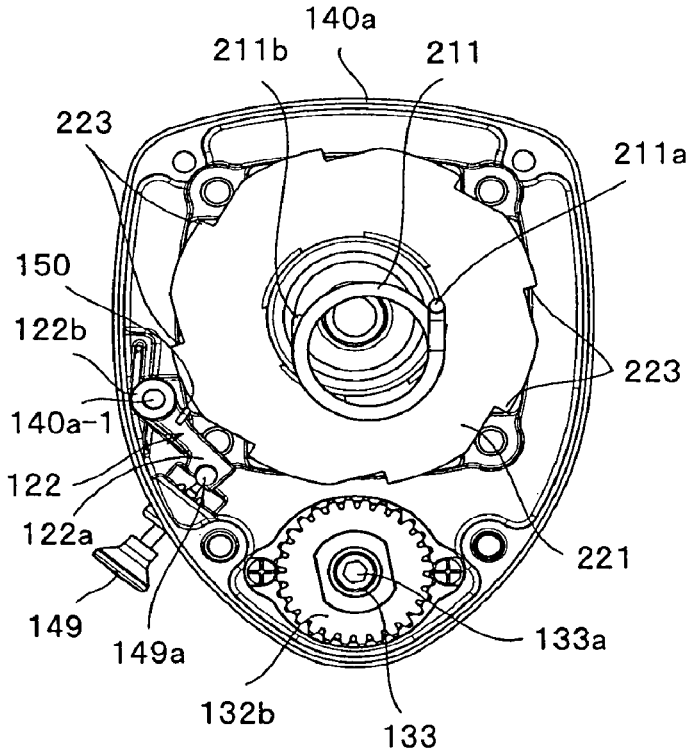
FIG. 10 is a front view of a non-engagement state of the releasing means and the power transmission unit viewed from the back side in FIG. 7.
Figure 11:
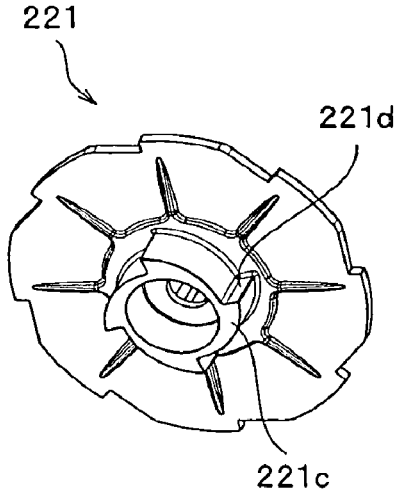
FIG. 11 is a perspective view showing the driving wheel of the power transmission unit from the front side.

FIG. 7 shows an exploded view of the engine starter according to the second embodiment of the invention and the engine at their assembly time, FIG. 8 is an exploded view magnifying the main portion of the engine starter, FIG. 9 is a back side view of FIG. 7 showing the engaged state of a releasing means in a driving pulley, FIG. 10 is a back side view of FIG. 7 showing the non-engaged state of the releasing means, and FIG. 11 is a perspective view seen from the front surface of the driving pulley. The second embodiment is different from the first embodiment in the power accumulating unit 210 and the power transmission unit 220 as apparent from FIG. 1, and the other components of the engine 10, the case 140, and the electric driving unit 130 are the same as those of the first embodiment. Therefore, the same reference numerals are attached to the same components, with the same terms used, other than the power accumulating unit 210 and the power transmission unit 220.

Therefore, in the following description, the power accumulating unit 210 and the power transmission unit 220 will be mainly described more concretely with reference to FIG. 2.

The power accumulating unit 210 according to the second embodiment includes a coil spring 211 and a coil spring end supporting gear 212, as illustrated in FIG. 7 and FIG. 8, and a spur gear 213 to be continued in a peripheral direction is formed on the half of the outer peripheral surface of the coil spring end supporting gear 212. A through hole 212*a* is formed in the center of the coil spring end supporting gear 212, an outer wheel of the one-way clutch 214 of the bearing shape is closely attached to the through hole 212*a*, and the shaft 145 of the second case 140*b* is inserted into the inner wheel of the one-way clutch 214. An outer end fixing hole, not illustrated, for fixing the one end 211*a* of the coil spring 211 is formed on one portion of the coil spring end supporting gear 212 on the side of the engine.

Figure 12:
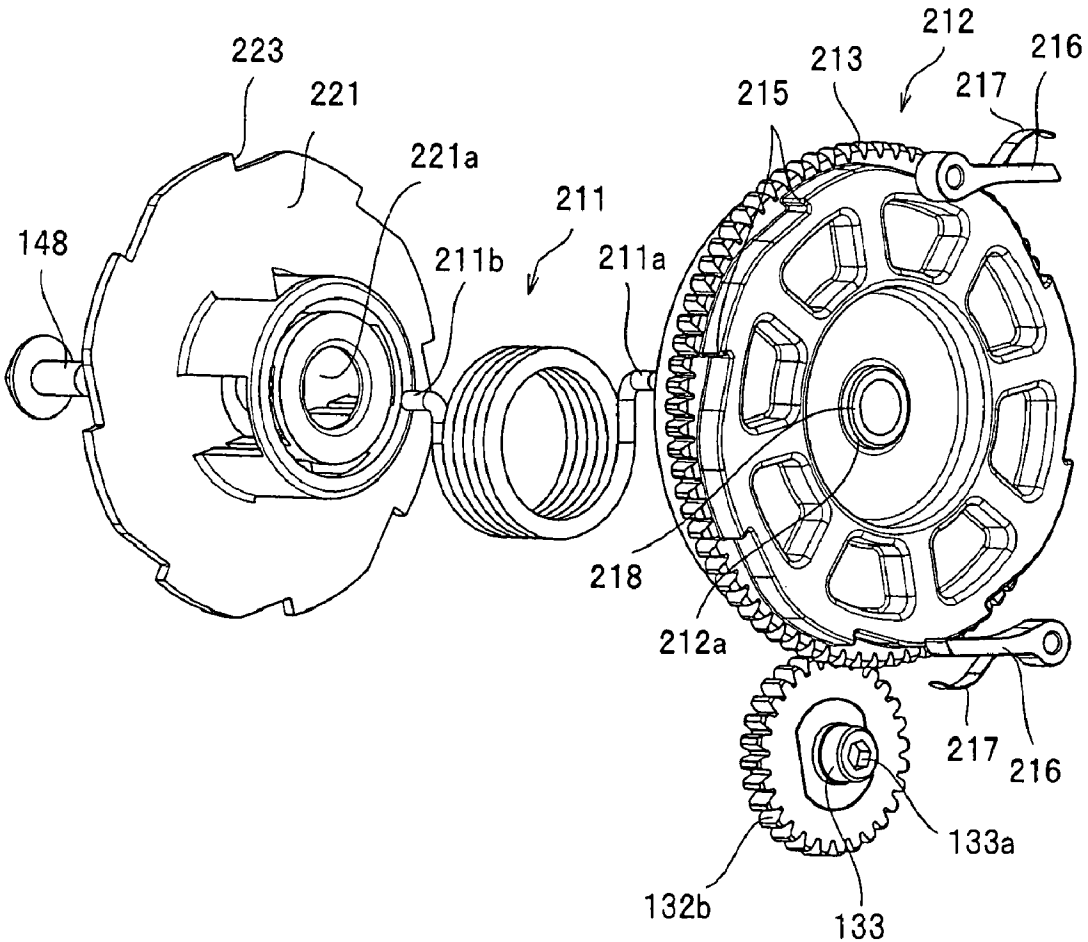
FIG. 12 is an exploded perspective view showing the important portion of the variation example in the second embodiment in a magnified way.

Even in the second embodiment, although the coil spring end supporting gear 212 is designed to be rotatable only in one direction through the one-way clutch 114 of the bearing shape as mentioned above, for example, another ratchet tooth 215, instead of the one-way clutch 214, may be formed on the outer peripheral surface of the coil spring end supporting gear 212, besides the spur gear 213, as illustrated in FIG. 12, and a ratchet claw 216 to be engaged in the ratchet tooth 215 may be formed on one portion of the second case 140*b*, hence to allow the coil spring end supporting gear 212 to rotate only in one direction, similarly to the first embodiment. Here, the ratchet claw 216 is similarly urged toward the direction of being engaged in the ratchet tooth 215 by a spring member 217 mounted on the second case 140*b*. Also in this case, the coil spring end supporting gear 212 is rotatively supported by the shaft 145 of the second case 140*b* through an ordinary flat bearing 218 similarly to the first embodiment.

On the other hand, the power transmission unit 220 is formed by a starting pulley 221 and the releasing member 122 which releases the starting pulley 221, as illustrated in FIG. 8 to FIG. 11. A loose hole 221*a* for loosely inserting the shaft 145 protruding from the second case 140*b* is formed in the center of the starting pulley 221 and as illustrated in FIG. 2, a spring end fixing unit 221*b* protruding toward the coil spring end supporting gear 212 is formed in the center of the starting pulley 221 on the opposite side of the engine in a way of surrounding the loose hole 221*a*. An attaching unit 221*b*' for attaching and supporting the other end 211*b* of the coil spring 211 is formed on the coil spring end fixing unit 221*b* and the other end 211*b* is fixedly supported. Also in the second embodiment, the axis line of the shaft 145 becomes the first axis line of the invention.

An engaged protruding portion 221*c*, having the ratchet tooth 221*d* on the peripheral surface to be engaged in the catching claw 12 that is one element of the centrifugal clutch mechanism mounted on a fan, not illustrated, fixed to the crank shaft 11 of the engine 10, as illustrated in FIG. 11, is protruded in the center of the starting pulley 221 on the side of the engine, similarly to the first embodiment. Although the engaged protruding portion 221*c* is at a halt, being engaged in the catching claw 12 mounted on the crank shaft 11, while receiving the energy in a releasing direction occurring in the process of accumulating a spring force in the coil spring 211 through rotation of the coil spring end supporting gear 212, until the power of the spring exceeds the maximum load of the engine, the engaged protruding portion 221*c* as being engaged in the catching claw 12 starts rotating and makes the engine start when the accumulated power in the coil spring 211 exceeds the maximum load. When the rotation of the engine comes into a constant state, the catching claw 12 is released from the engagement with the engaged protruding portion 221*c* of the starting pulley 221 owing to the centrifugal power and the rotation of the engine is maintained.

The ratchet teeth 123 are formed at predetermined intervals on the outer periphery of the starting pulley 221 and the whole starting pulley 221 is formed as a ratchet wheel. One end 122*b* of the releasing member 122 is supported rotatably by the boss 140*a*-1 of the first case 140*a*, the push button 149 operates the rotation of its distal end 122*a*, to set the outer peripheral ratchet tooth 223 of the starting pulley 221 free or tight, thereby to allow or disable the rotation of the starting pulley 221. The distal end 122*a* of the releasing member 122 is urged toward the direction of releasing itself from the ratchet tooth 123 by the spiral screw 150 at the ordinary engine start and the distal end 122*a* can be engaged in the ratchet tooth 123 only by rotating the one end 122*b* against the urged force of the spiral screw 150. The releasing member 122 and the ratchet tooth 223 of the starting pulley 221 correspond to the rotation preventing means in the invention. The operation or the movement of the releasing member 122 is the same as that in the first embodiment, and its description is omitted.

In the electric engine starter 100 according to the second embodiment having the above structure, as mentioned above, the conventional recoil driving unit and battery are eliminated from the case 140, the coil spring end supporting gear 212 accommodating the coil spring 211 of the power accumulating unit 210 and the starting pulley 221 of the power transmission unit 120 are supported on the same shaft 145, only the electric motor 131 that is the electric driving unit 130 and the planetary gear mechanism 132*a* and the spur gear 132*b* forming the reduction gear mechanism 132 are arranged on the axis line (second axis line) parallel to the shaft 145 in the vertical lower portion of the shaft 145, and ultra-compact motors are used as the electric motor 131 and the planetary gear mechanism 132*a*. Therefore, they are accommodated in the case 140 extremely compactly. As a result, the whole starter can be extremely downsized even in the second embodiment.

By the arrangement of the above-mentioned electric motor 131, similarly to the first embodiment, the gravity center of the whole engine with the engine starter 100 mounted thereon is moved toward the straight line connecting the center of the crank shaft 11 and the shaft center of the electric motor 131, and it is moved a little downwardly from the position of the gravity center of the engine 1 with no engine starter 100 mounted thereon. Therefore, the balance of the whole engine on the both sides with the engine starter 100 mounted thereon is improved and its position is lowered, the rotation torque straining the user's hand at the working time is little generated, fatigue during the operation of the working machine caused by the unbalance can be reduced, and the stable work can be continued for a long time.

When the battery is charged, for example, the starter 100 can easily start the rotation of the engine 10 through turning on a switch provided on a handle. However, when the electric motor 131 cannot be driven because the battery is dead due to some reasons or because of the failure of the motor itself, the engine 10 can be started by hand. According to the embodiment, in the above emergency, at first, the push button 149 is pushed, to make the releasing member 122 into engagement with the ratchet tooth 223 of the starting pulley 121 against the urged force of the releasing member 122. After confirming this engagement, for example, the hexagonal wrench, not illustrated, is inserted into the wrench insertion hole 146 formed on the back surface of the case 140 in FIG. 7, to be engaged in the engaged portion 133*a* formed on the end of the output shaft 133 of the reduction gear mechanism 132. Next, by rotating the hexagonal wrench, the spur gear 132*b* of the reduction gear mechanism 132 is rotated, to rotate the coil spring end supporting gear 212 in a direction of accumulating the power. At the same time, the compact electric motor 131 is to be rotated a little. Though the rotating operation of the hexagonal wrench is performed by hand, since the reduction gear mechanism 132 is interposed between the compact electric motor 131 and the coil spring end supporting gear 212, the rotation torque of the compact electric motor 131 is a little and there is no problem on the operation.

At the operating time of the wrench, since the above releasing member 122 is engaged in the starting pulley 221, as mentioned above, no power is transmitted between the starting pulley 221 and the crankshaft 11. As a result, the wrench operation can be performed intensively at ease until the coil spring 211 has fully accumulated the power. In this manner, when the coil spring 211 has accumulated the power enough to start the engine, the hexagonal wrench is removed from the wrench insertion hole 146 of the case 140 by releasing the engagement with the supporting shaft end of the spur gear 132*b* and the push button 149 is pushed to remove the releasing member 122 from the ratchet tooth 223 of the starting pulley 221. At this point, since the coil spring 211 has accumulated the power enough to start the engine 10, the engine starts the rotation at the moment when the engagement is released.

As apparent from the above description, according to the electric engine starter of the invention, since the battery is arranged outside of the device and the conventionally well-known recoil driving unit is removed therefrom, by the efficient arrangement of the working members, downsizing and weight saving of the whole device can be realized, and when the electric motor cannot be driven, the engine can be started by manual operation easily and safely, similarly to the conventional electric engine starter. Further, according to the invention, since the electric motor is arranged in consideration of the position of the gravity center of the whole engine with the engine starter mounted thereon, the lateral balance of the engine with the starter is improved, without feel of straining the hand during the operation of the working machine, and the stable operation with less fatigue during the operation is possible.

What is claimed is:

1. An engine starter comprising a compact electric motor which is driven by a battery, a power accumulating unit which transmits a power of the compact electric motor through a high-speed reduction gear mechanism in a direction of accumulating power, and a power transmission unit which transmits an accumulated power of the power accumulating unit to a crank shaft of an engine, wherein the battery is arranged outside the engine starter, the power accumulating unit has a spring and a rotation supporting member for supporting one end of the spring, the rotation supporting member having a first gear on its outer peripheral surface, a second gear is fixed to an output shaft of the high-speed reduction gear mechanism, the first and the second gears are engaged with each other, the power accumulating unit, the power transmission unit, and the crank shaft are arranged on the same first axis line and the compact electric motor and the high-speed reduction gear mechanism are arranged on the same second axis line parallel to the first axis line, the second axis line where the compact electric motor is placed is arranged on a straight line, below the first axis line, connecting a center of gravity of the whole engine including peripheral units around a muffler and a carburetor, with the engine starter mounted thereon, and an axis line of the crank shaft, and the center of gravity rests in a plane defined by the first and second axis lines, and the starter is thereby configured to be mounted to the engine so that a center of gravity for the engine and starter in combination is placed within the plane.

2. The engine starter according to claim 1, wherein the high-speed reduction gear mechanism has a planetary reduction gear mechanism.

3. The engine starter according to claim 1 or 2, wherein the spring is a spiral spring and the rotation supporting member is a spring barrel drum.

4. The engine starter according to claim 1 or 2, wherein the spring is a coil spring and the rotation supporting member is a gear.

5. The engine starter according to claim 1 or 2, wherein the rotation supporting member has a one-way rotating means.

6. The engine starter according to claim 1 or 2, wherein the first and the second gears are spur gears.

7. The engine starter according to claim 1 or 2, including a rotation operating mechanism which rotates an output shaft by hand and sets the shaft end of the output shaft free or tight, being positioned on the second axis line on which the output shaft of the high-speed reduction gear mechanism is arranged.

8. The engine starter according to claim 1 or 2, including a rotation preventing means which ordinarily allows the rotation in a direction of releasing the power of the power accumulating unit or the power transmission unit and prevents the rotation in the direction of releasing the power at a halt of the electric motor.

9. The engine starter according to claim 8, wherein the power transmission unit has a starting pulley connected to the crank shaft through a switching means, and the rotation preventing means has a plurality of ratchet teeth formed on the outer periphery of the starting pulley and a releasing member for setting the ratchet tooth free or tight.

10. The engine starter according to claim 3, wherein the rotation supporting member has a one-way rotating means.

11. The engine starter according to claim 4, wherein the rotation supporting member has a one-way rotating means.

* * * * *

UNITED STATES PATENT AND TRADEMARK OFFICE

CERTIFICATE OF CORRECTION

PATENT NO. : 7,594,490 B2
APPLICATION NO. : 12/062990
DATED : September 29, 2009
INVENTOR(S) : Ryou Ono It is certified that error appears in the above-identified patent and that said Letters Patent is hereby corrected as shown below:

Title page, item [73] replace the Assignee with "Husqvarna Zenoah Co., Ltd.".

Signed and Sealed this

Thirteenth Day of April, 2010

David J. Kappos

David J. Kappos
*Director of the United States Patent and Trademark Office*